US009439825B2

(12) United States Patent
Bard et al.

(10) Patent No.: US 9,439,825 B2
(45) Date of Patent: Sep. 13, 2016

(54) WALKER DOCKING STATION

(71) Applicants: Arnold Darryl Bard, Long Branch, NJ (US); Robert Alan Bard, Loveladies, NJ (US)

(72) Inventors: Arnold Darryl Bard, Long Branch, NJ (US); Robert Alan Bard, Loveladies, NJ (US)

( * ) Notice: Subject to any disclaimer, the term of this patent is extended or adjusted under 35 U.S.C. 154(b) by 0 days.

(21) Appl. No.: 14/537,988

(22) Filed: Nov. 11, 2014

(65) Prior Publication Data

US 2015/0129735 A1 May 14, 2015

Related U.S. Application Data

(60) Provisional application No. 61/979,487, filed on Apr. 14, 2014, provisional application No. 61/902,851, filed on Nov. 12, 2013.

(51) Int. Cl.

| | |
|---|---|
| ***A47B 91/08*** | (2006.01) |
| ***A61H 3/04*** | (2006.01) |
| *A61G 5/10* | (2006.01) |

(52) U.S. Cl.

CPC ..... *A61H 3/04* (2013.01); *A61G 2005/1086* (2013.01)

(58) Field of Classification Search

CPC ..... A61H 3/04; A61H 2003/046; A61H 2003/043; A61G 2005/1086; A61G 2005/1089; A61G 5/10; A61G 5/1013; A61G 5/1016; A61G 5/1029; A47B 2097/008; A45B 1/02

USPC ..... 135/66; 248/500, 501, 499, 510

See application file for complete search history.

(56) References Cited

U.S. PATENT DOCUMENTS

| | | | | |
|---|---|---|---|---|
| 3,085,258 | A * | 4/1963 | Wolferts | A61H 3/00 135/67 |
| 3,272,530 | A | 9/1966 | Klassen | |
| 4,314,576 | A | 2/1982 | McGee | |
| 4,771,867 | A * | 9/1988 | Fernandes | A61G 5/1029 188/29 |
| 4,843,661 | A | 7/1989 | Skibinski | |
| 4,883,282 | A | 11/1989 | Wolf et al. | |
| 4,922,560 | A | 5/1990 | Skibinski | |
| 5,449,013 | A | 9/1995 | Landers | |
| 5,509,432 | A | 4/1996 | Peterson | |
| 5,983,911 | A | 11/1999 | Steele | |
| 6,170,501 | B1 | 1/2001 | Cook et al. | |
| 6,244,285 | B1 | 6/2001 | Gamache | |
| 6,643,869 | B1 | 11/2003 | Sloan, Jr. et al. | |
| 6,672,321 | B2 * | 1/2004 | Hamilton | A61H 3/04 135/66 |
| 6,860,281 | B1 | 3/2005 | Clift | |
| 7,775,228 | B2 | 8/2010 | Clark | |
| 7,871,088 | B2 * | 1/2011 | Silva | A61G 5/10 135/66 |

FOREIGN PATENT DOCUMENTS

| | | |
|---|---|---|
| GB | 2190004 A | 11/1987 |

* cited by examiner

*Primary Examiner* — Christopher E Garft

(74) *Attorney, Agent, or Firm* — Keith D. Nowak; Carter Ledyard & Milburn LLP

(57) ABSTRACT

A walker stabilizing platform including a movement restrictor assembly for assisting a user of a walker in transitioning from a sitting position to a standing position wherein the movement restrictor assembly automatically moves from a position of engagement with the walker to a position of disengagement with the walker, and further includes means for allowing the user of the walker to move the movement restrictor assembly from the disengaged position to the engaged position without assistance.

3 Claims, 12 Drawing Sheets

WALKER DOCKING STATION

PRIORITY AND RELATED APPLICATIONS

The present invention claims priority to U.S. Provisional Patent Application Ser. No. 61/902,851 filed on Nov. 12, 2013, entitled "Walker Stabilization Device", and U.S. Provisional Patent Application Ser. No. 61/979,487 filed on Apr. 14, 2014, entitled "Walker Docking Station" both of which are incorporated herein by reference.

FIELD OF THE INVENTION

The present invention relates generally to devices and methods to assist a person who requires the use of a walker to transition from a sitting position to a standing position.

BACKGROUND OF THE INVENTION

Walkers are common moving aids to assist limited mobility people in moving around. These people also have difficulty in transitioning from a sitting position to a standing position and thus often need assistance, which can be difficult, such as requiring the assistance of another person or the assistance of a power device. There are existing devices to assist limited mobility people to sit and to rise. However, these devices are complicated and in general, difficult to utilize. Thus there is a need for a portable device used in conjunction with a walker that enables a person to transition from a sitting to a standing position, which is easy to use, simple in construction and easily adjustable.

SUMMARY OF THE INVENTION

The present invention relates to walkers and methods to stabilize a walker when a person using the walker transitions from a sitting position to a standing position.

The Walker Docking Station (WDS) is an apparatus to assist the user of a walker when transitioning from a sitting to a standing position. The lifting of the walker's front legs poses a significant problem when a user tries to make this transition because the user will be pulling on the walker handles and, without stabilization, the walker's front legs often lift and/or move backwards towards the user. Any unsteadiness of the walker could cause the user to lose his or her balance and fall. This could result in injury to the user or even injuring an aide or caregiver who may be trying to assist the user. The WDS minimizes the lifting or backwards movement of the front legs of a walker when the user transitions from a sitting to a standing position.

The WDS is primarily designed to be used with walkers that have wheels attached to its front legs via an axle and where there is a small amount of space between the walker's leg and the wheels.

Although a walker without front wheels could be modified to work with the WDS, the intent is to use the WDS with a walker that has wheels attached to its front legs.

BRIEF DESCRIPTION OF THE DRAWINGS

The present invention may be further understood from the following description in conjunction with the drawings.

DETAILED DESCRIPTION OF THE INVENTION

Figure 1:
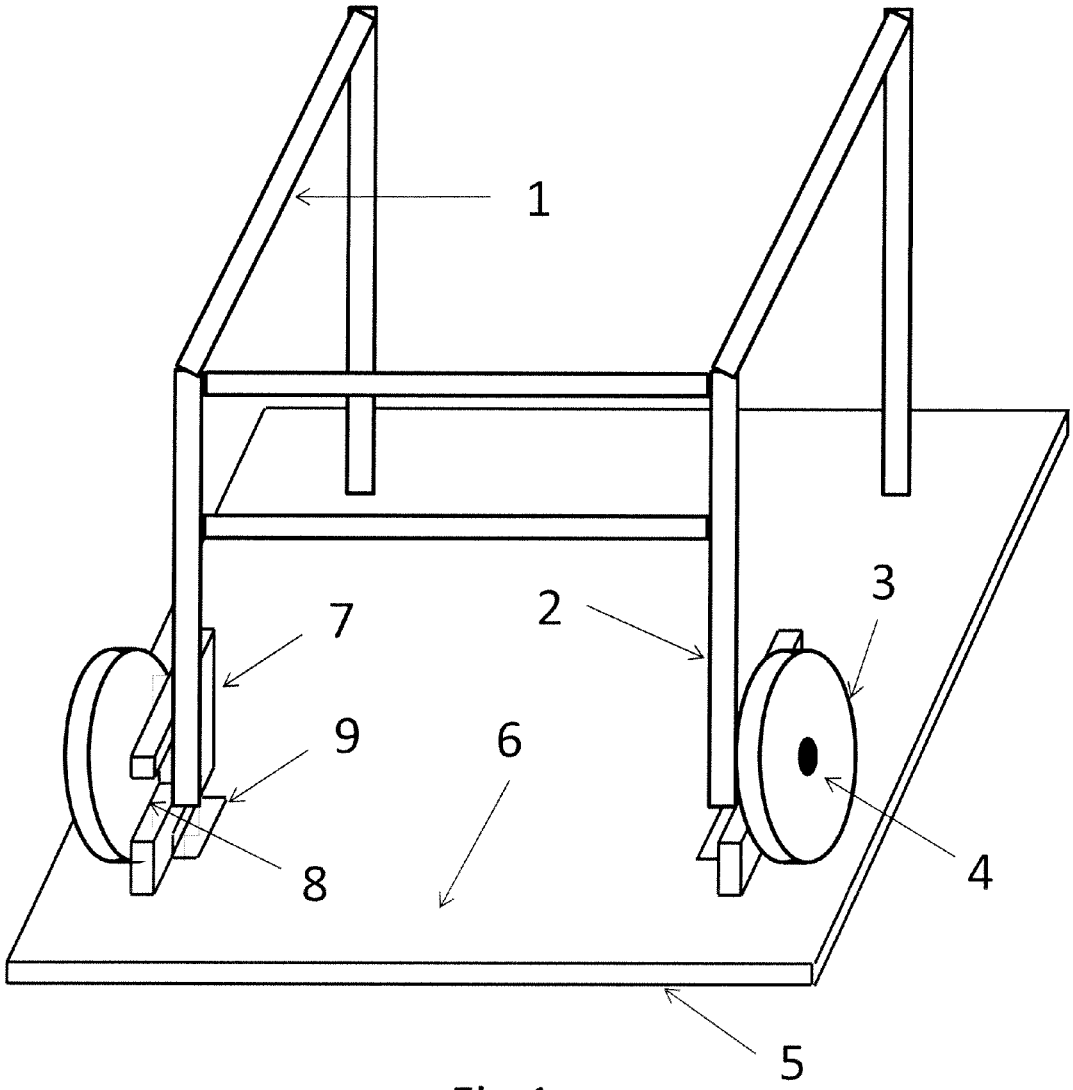
FIG. 1 is an illustration of an isometric view of a walker.
Figure 2:
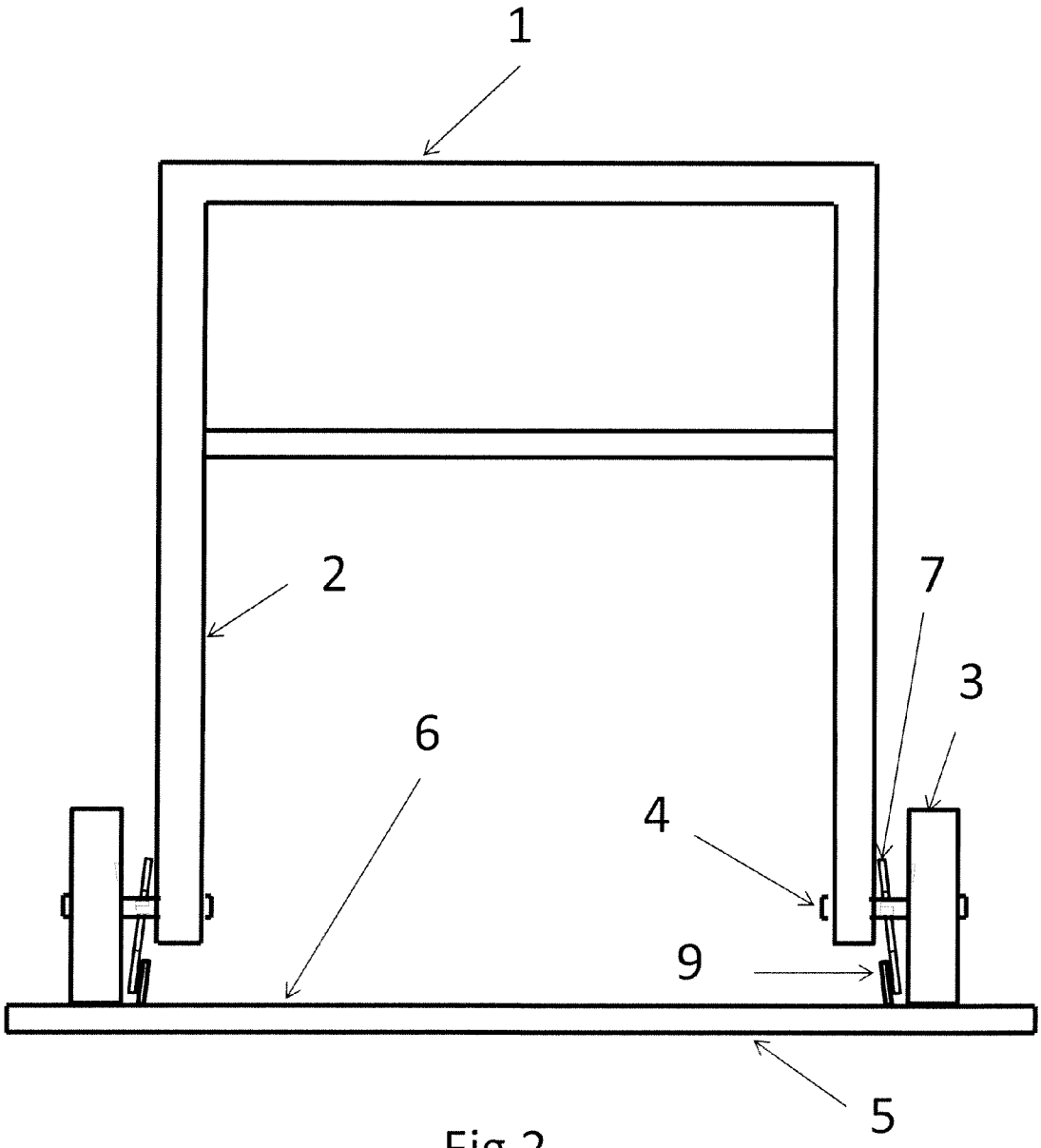
FIG. 2 is an illustration of front view of a walker that is captured or secured on a WDS.
Figure 3:
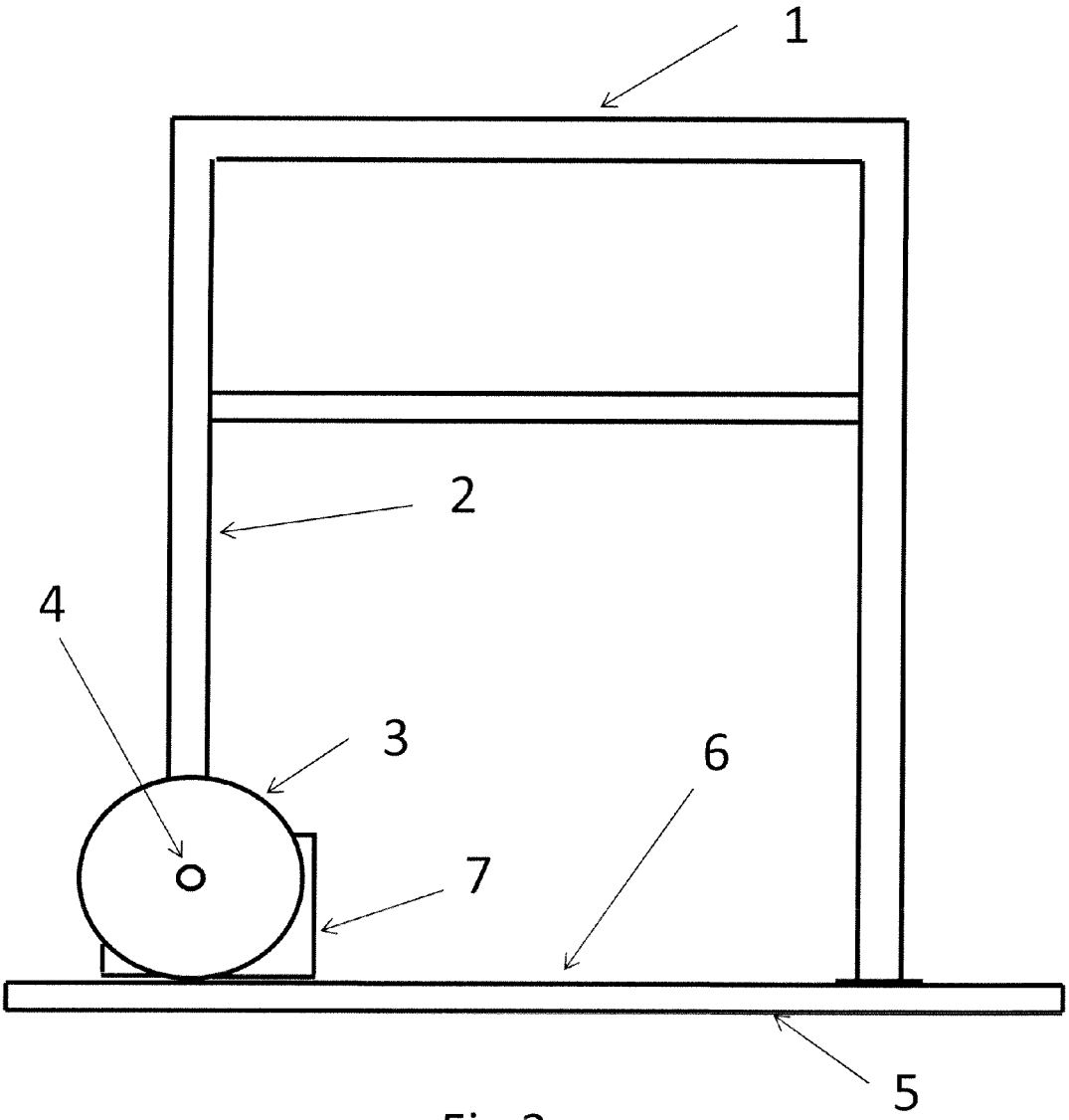
FIG. 3 is an illustration of the side view of a walker that is captured or secured on a Walker Docking Station.
Figure 4:
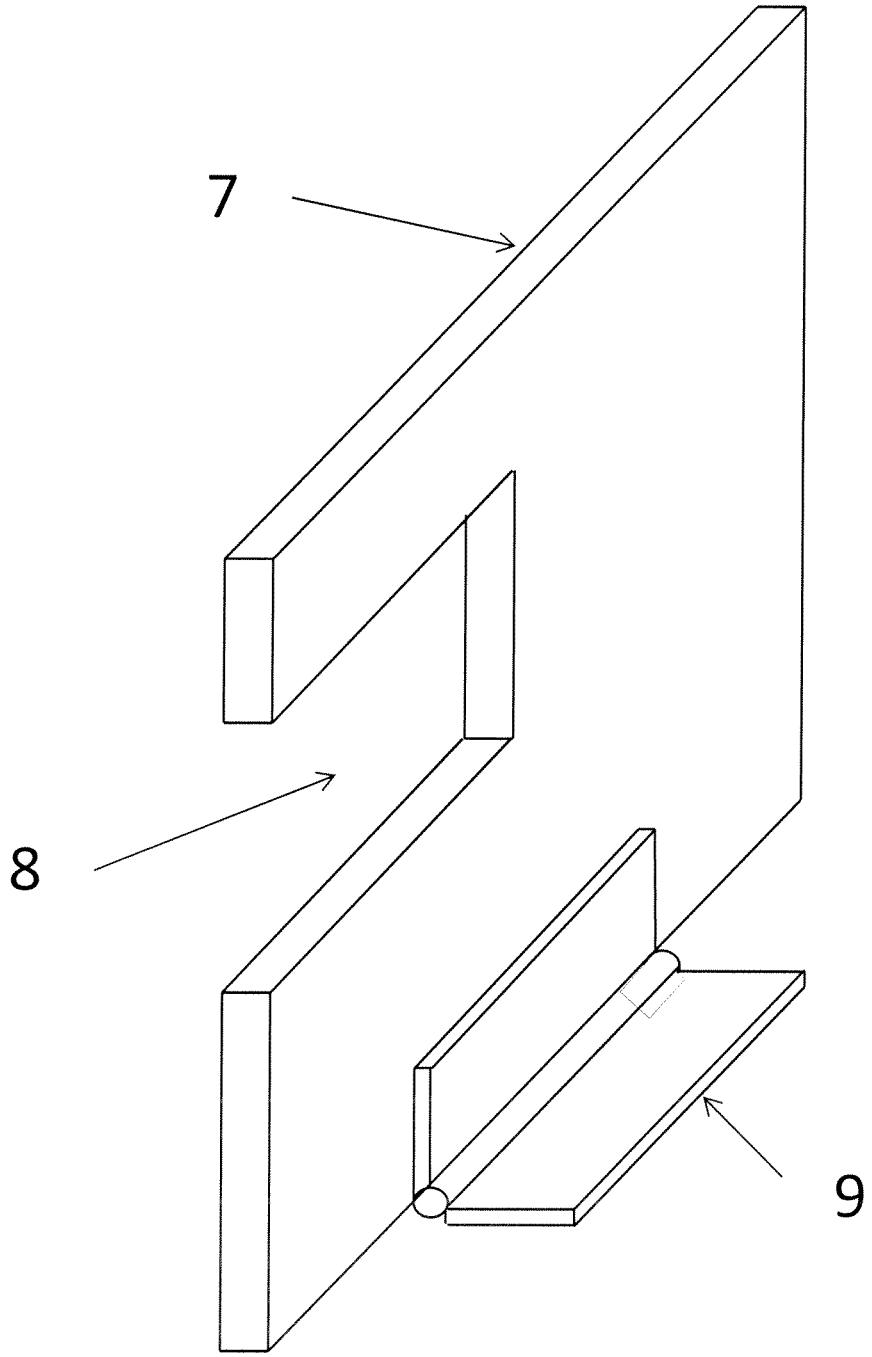
FIG. 4 is an illustration of a Walker Movement Restrictor Assembly (WMRA).

There are four versions of the WDS that will be discussed. They are the Self-Closing Hinge based WDS, the Elastic-Band based WDS, the Wedge based WDS and the Spring based WDS. All four WDS's operate on the same principle and consist of a base and a Walker Movement Restrictor Assembly (WMRA). FIG. 1 is an illustration of an isometric view of a Walker (1) that is captured or secured on a WDS (5). The walker's front leg (2) has a wheel (3) that is attached to the walker via an axle (4). The base (6) of the WDS has a WMRA attached to it. The base may be a portable surface or a floor. The WMRA consists of a hinge (9) and a flat plate (7) and the flat plate has a cutout (8). The flat plate with its cutout is also known as the Walker Capture Plate (WCP). The cutout is used to partially surround the walker's axle when the walker is being captured or secured by the WDS. The hinge is used to couple the WCP to the base and allows the WCP to rotate or pivot on the base.

Figure 5:
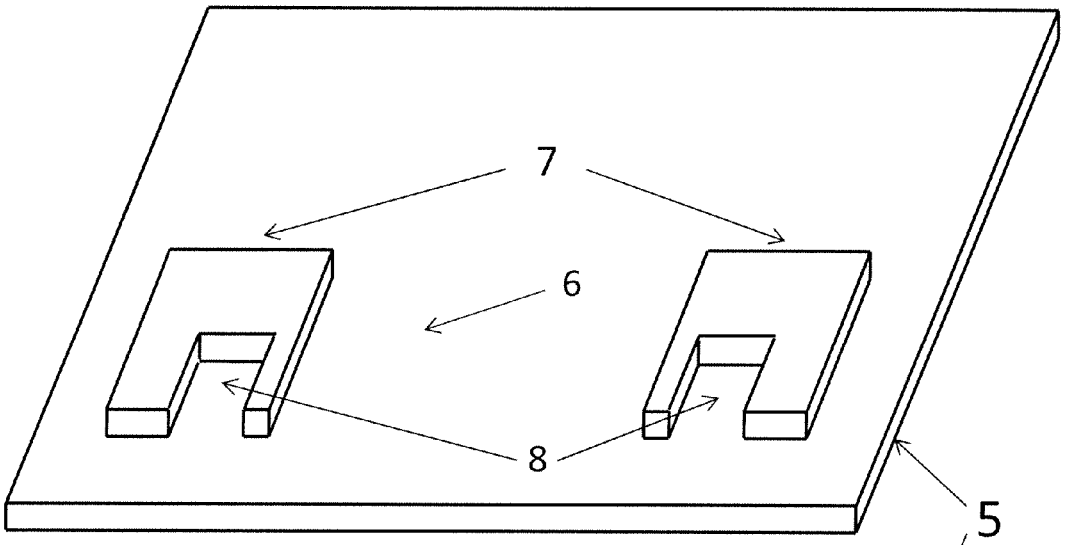
FIG. 5 is an illustration of WCP's in a down or horizontal position.
Figure 6:
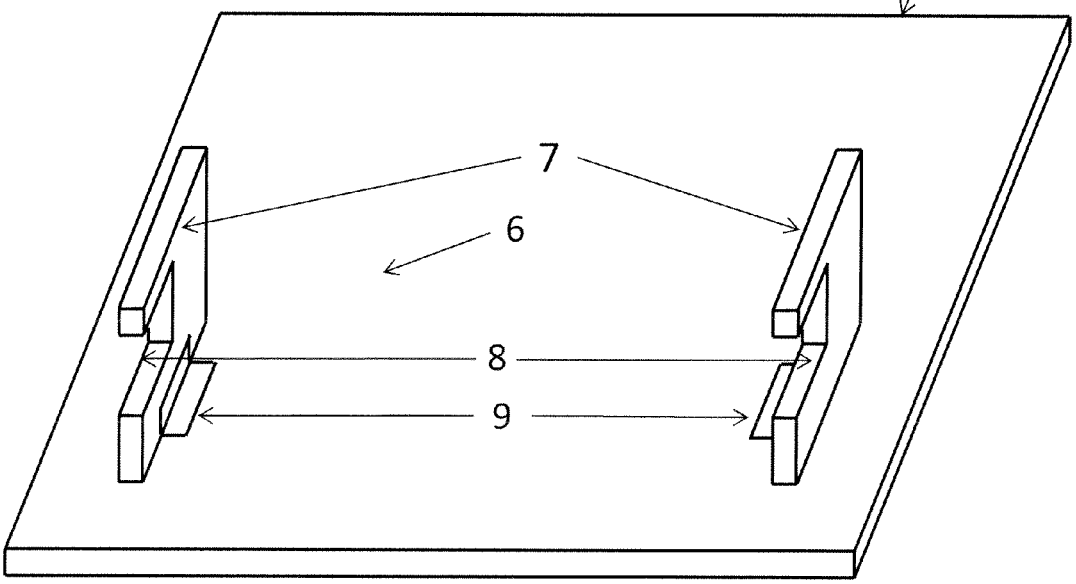
FIG. 6 is an illustration of WCP's in an upright or vertical position relative to the base.

The natural position of the WCP is in the down or horizontal position relative to the base as shown in FIG. 5. When the WCP is in the upright or vertical position relative to the base, the WCP has either captured or is in the process of capturing a walker. Each WDS's WCP functions the same in that they capture or secure the walker's axle and holds the walker to the base. The difference is in the mechanism that is used in transitioning the WCP from its upright or vertical position to its down or horizontal position. Each of these mechanisms will be described later in the details of each WDS.

Although it is possible to construct a WDS using only one WCP, the WDS is more effective when each front wheel's axle is captured and secured by its own WCP.

The following section describes the operational setup and use of a WDS that has a portable base and two WMRA's. The walker is the type that has wheels on each of its front legs.

An aide or caregiver is expected to perform all tasks associated with getting the WDS ready for the user.

1. The aide or caregiver places the WDS in front of the user while he or she is sitting. The WCP's are in their down or horizontal position relative to the base with the WCP cutouts facing away from the user.
2. The aide or caregiver places the walker on the base of the WDS so that each walker's front leg is positioned in front of its corresponding WCP and the WCP can be rotated to a vertical or upright position without interference from the walker's leg. The aide or caregiver operates on one walker's front leg at a time.
3. The aide or caregiver lifts the first WCP to an upright or vertical position and moves the walker's leg backwards towards the user, so that the WCP lies between the walker's leg and wheel, and the WCP's cutout is partially surrounding the walker's axle.
4. The aide or caregiver performs the same procedure as in step 3 on the other front leg.
5. The aide or caregiver pushes the walker backwards until the walker's axles make contact with and are firmly seated in the cutouts of each of the WCP's.
6. The user places his or her feet on the base, grips the handles of the walker and pulls himself or herself up. If necessary, the aide or caregiver can step on the front of the base as the user pulls up. This helps to minimize any lifting of the WDS and walker.
7. Once the user is standing on the base, the user moves forward with the walker and as the walker's front legs leaves the WCP's, the WCP's rotate down and end up in a horizontal position relative to the base. The user is then able to go in any direction he or she desires.

Although it is desirable for the WCP to lie between the walker's front leg and wheel, the WDS can be designed to capture the end of the axle or an extending rod that is attached to the front legs of a walker without wheels; however, the walker is more secured when the WCP is positioned to lie between the walker's leg and wheel.

The Self-Closing Hinge based WDS uses a self-closing or a spring-loaded hinge, (10) that is normally closed unless there are forces trying to keep it open. When the WCP is in the upright or vertical position and positioned between the walker's leg and wheel, the self-closing hinge pulls on the WCP and keeps the WCP against the walker's leg. The walker's leg prevents the WCP from rotating or pivoting down and closing. When the walker's leg leaves the WCP, the self-closing hinge is free to close and the WCP transitions from an upright to a down position.

In the following three Self-Closing Hinge based WMRA figures, the WMRA is between the walker's front leg and wheel and the plate's cutout is partially surrounding the walker's axle.

Figure 7:
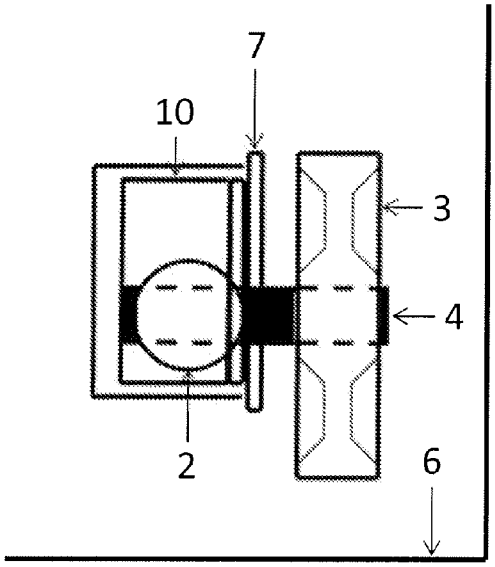
FIG. 7 is an illustration of the top view of a Self-Closing Hinge.

FIG. 7 is an illustration of the top view of a Self-Closing Hinge based WDS's WMRA with the lower portion of a walker's front leg that has a wheel attached to it.

Figure 8:
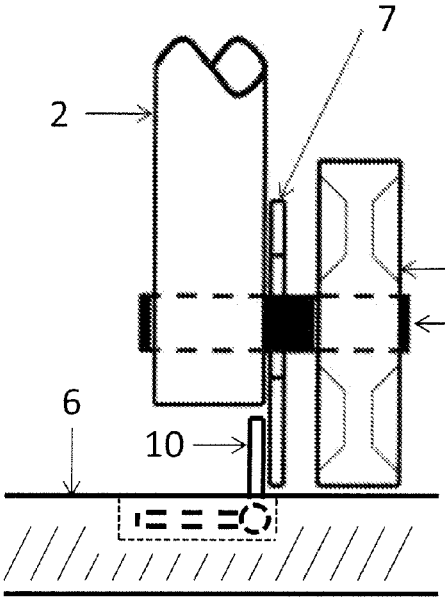
FIG. 8 is an illustration of the front view of a Self-Closing Hinge.

FIG. 8 is an illustration of the front view of a Self-Closing Hinge based WDS' WMRA with the lower portion of a walker's front leg that has a wheel attached to it.

Figure 9:
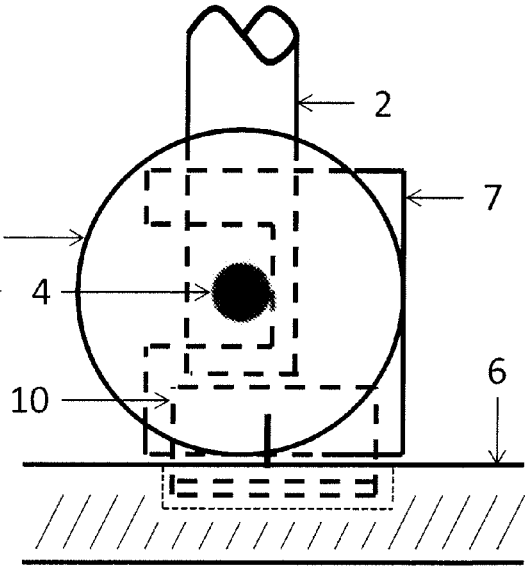
FIG. 9 is an illustration of the side view of a Self-Closing Hinge.

FIG. 9 is an illustration of the side view of a Self-Closing Hinge based WDS' WMRA with the lower portion of a walker's front leg that has a wheel attached to it.

The Elastic-Band based WDS has an elastic band, (11) such as a rubber band or bungee cord, where one end of the elastic band is secured to the base of the WDS and the other end of the elastic band is secured to the WCP. When the WCP is in the upright or vertical position and positioned between the walker's leg and wheel, the elastic band pulls on the WCP and keeps the WCP against the walker's leg. The walker's leg prevents the WCP from rotating or pivoting down and closing. When the walker's leg leaves the WCP, the elastic band pulls on the WCP and transitions the WCP from an upright to a down position. The Elastic-Band based WDS uses a standard or conventional hinge.

In the following three Elastic-Band based WMRA figures, the WMRA is between the walker's front leg and wheel and the plate's cutout is partially surrounding the walker's axle.

Figure 10:
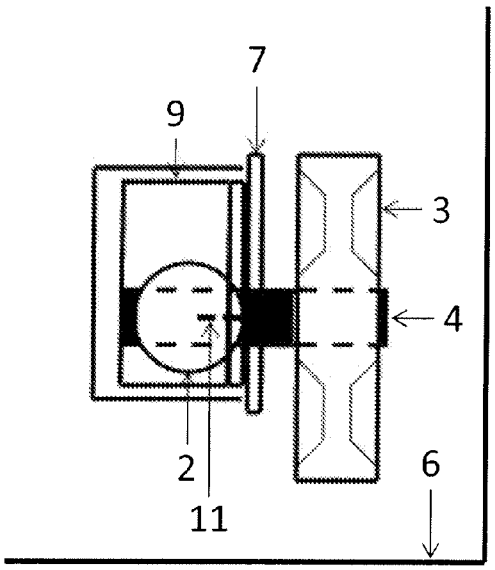
FIG. 10 is an illustration of the top view of an Elastic-Band based WDS.

FIG. 10 is an illustration of the top view of an Elastic-Band based WDS' WMRA with the lower portion of a walker's front leg that has a wheel attached to it.

Figure 11:
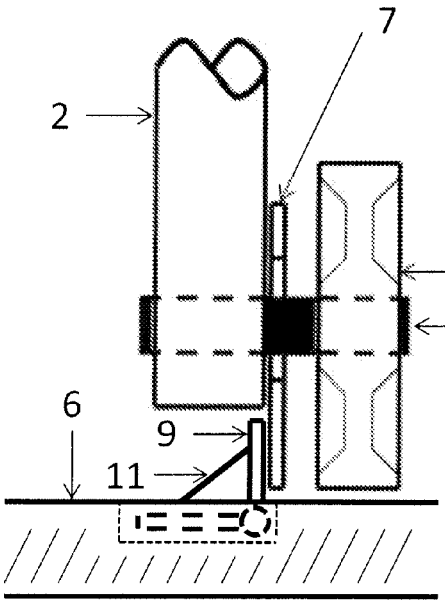
FIG. 11 is an illustration of the front view of an Elastic-Band based WDS.

FIG. 11 is an illustration of the front view of an Elastic-Band based WDS' WMRA with the lower portion of a walker's front leg that has a wheel attached to it.

Figure 12:
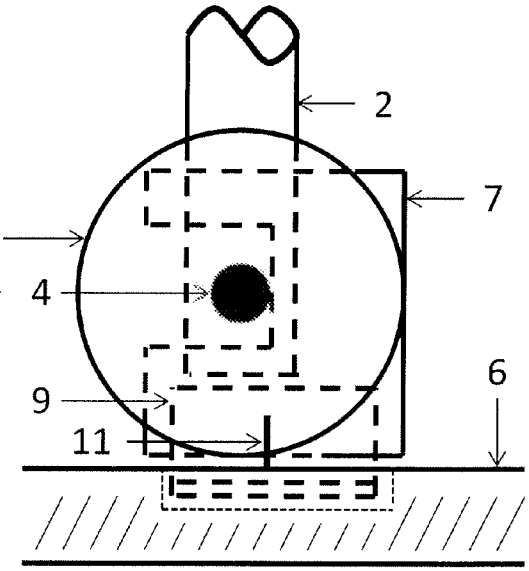
FIG. 12 is an illustration of the side view of an Elastic-Band based WDS.

FIG. 12 is an illustration of the side view of an Elastic-Band based WDS' WMRA with the lower portion of a walker's front leg that has a wheel attached to it.

The Wedge based WDS has a wedge (12) that is mounted on the side of the WCP that faces the wheel. The wedge is positioned so when the walker's leg leaves the WCP, the wedge is the very last part of the WCP that the wheel makes contact with and when the wheel makes contact with the wedge, the wheel pushes the WCP away and this action causes the WCP to rotate or pivot down. The Wedge based WDS uses a standard or conventional hinge.

In the following three Wedge based WMRA figures, the WMRA is between the walker's front leg and wheel and the plate's cutout is partially surrounding the walker's axle.

Figure 13:
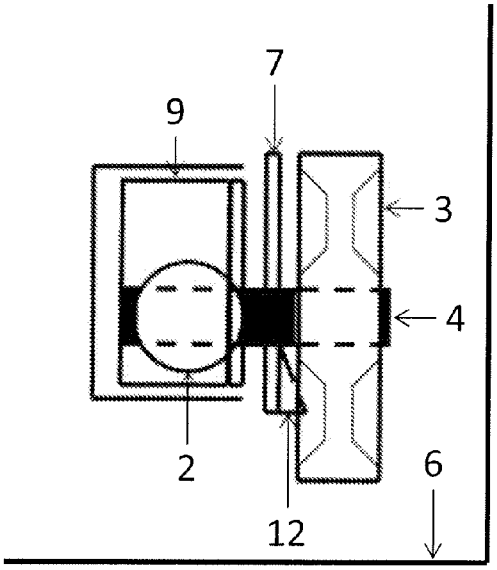
FIG. 13 is an illustration of the top view of a Wedge based WDS.

FIG. 13 is an illustration of the top view of a Wedge based WDS' WMRA with the lower portion of a walker's front leg that has a wheel attached to it.

Figure 14:
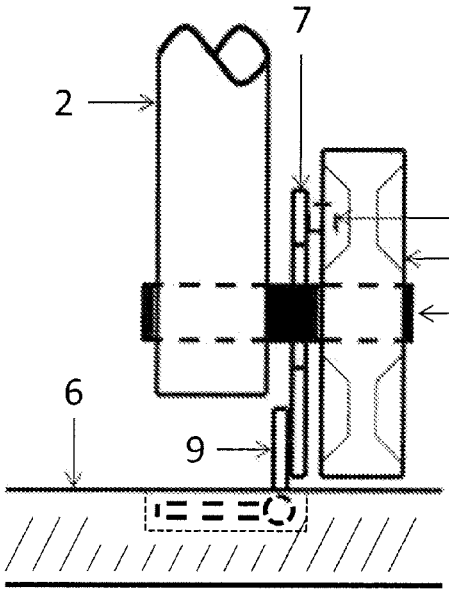
FIG. 14 is an illustration of the front view of a Wedge based WDS.

FIG. 14 is an illustration of the front view of a Wedge based WDS' WMRA with the lower portion of a walker's front leg that has a wheel attached to it.

Figure 15:
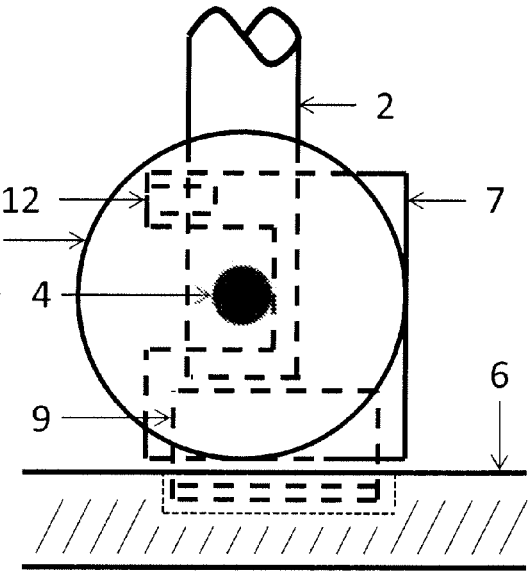
FIG. 15 is an illustration of the side view of a Wedge based WDS.

FIG. 15 is an illustration of the side view of a Wedge based WDS' WMRA with the lower portion of a walker's front leg that has a wheel attached to it.

The Spring based WDS has a spring (13) at the base or bottom of the WCP. When the WCP is in the upright position, the spring makes contact with the base and the spring pushes on the WCP. When the WCP is in the upright or vertical position and positioned between the walker's leg and wheel, the spring pushes the WCP against the walker's leg. The walker's leg prevents the WCP from rotating or pivoting down and closing. When the walker's leg leaves the WCP, the spring, pushing on the WCP causes the WCP to rotate from an upright to a down position. The Spring based WDS uses a standard or conventional hinge.

In the following three Spring based WMRA figures, the WMRA is between the walker's front leg and wheel and the plate's cutout is partially surrounding the walker's axle.

Figure 16:
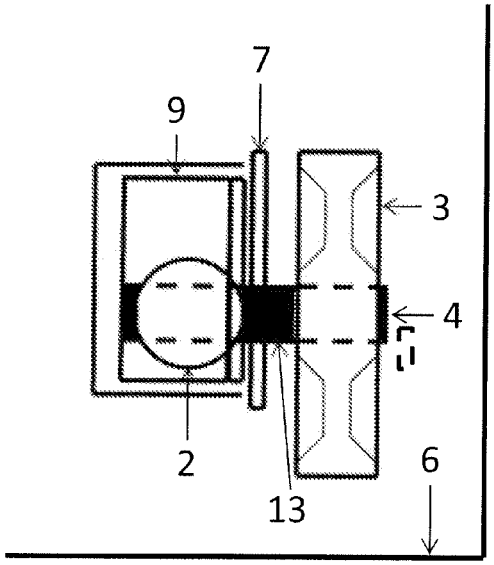
FIG. 16 is an illustration of the top view of a Spring based WDS.

FIG. 16 is an illustration of the top view of a Spring based WDS' WMRA with the lower portion of a walker's front leg that has a wheel attached to it.

Figure 17:
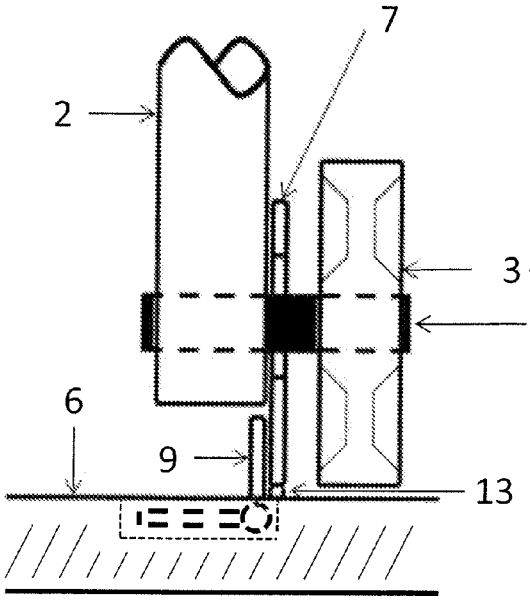
FIG. 17 is an illustration of the front view of a Spring based WDS.

FIG. 17 is an illustration of the front view of a Spring based WDS' WMRA with the lower portion of a walker's front leg that has a wheel attached to it.

Figure 18:
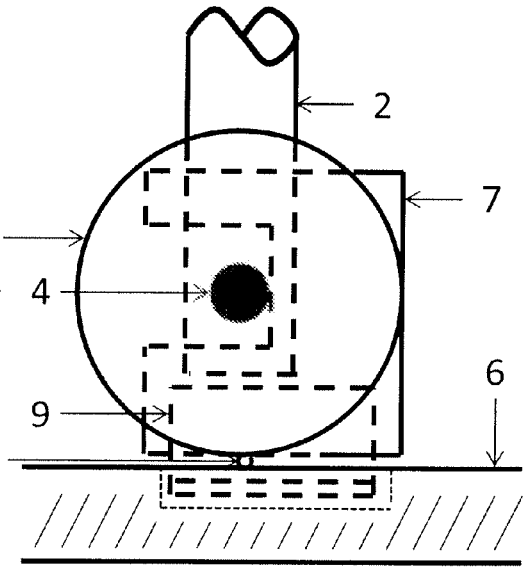
FIG. 18 is an illustration of the side view of a Spring based WDS.

FIG. 18 is an illustration of the side view of a Spring based WDS' WMRA with the lower portion of a walker's front leg that has a wheel attached to it.

Figure 19:
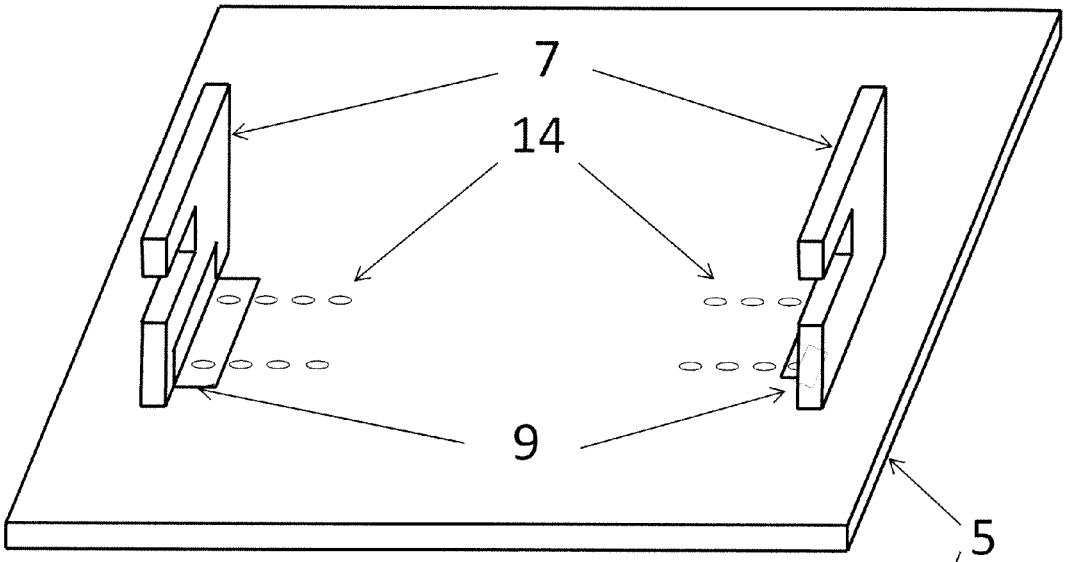
FIG. 19 is an illustration of the WDS Universal Base with holes.
Figure 20:
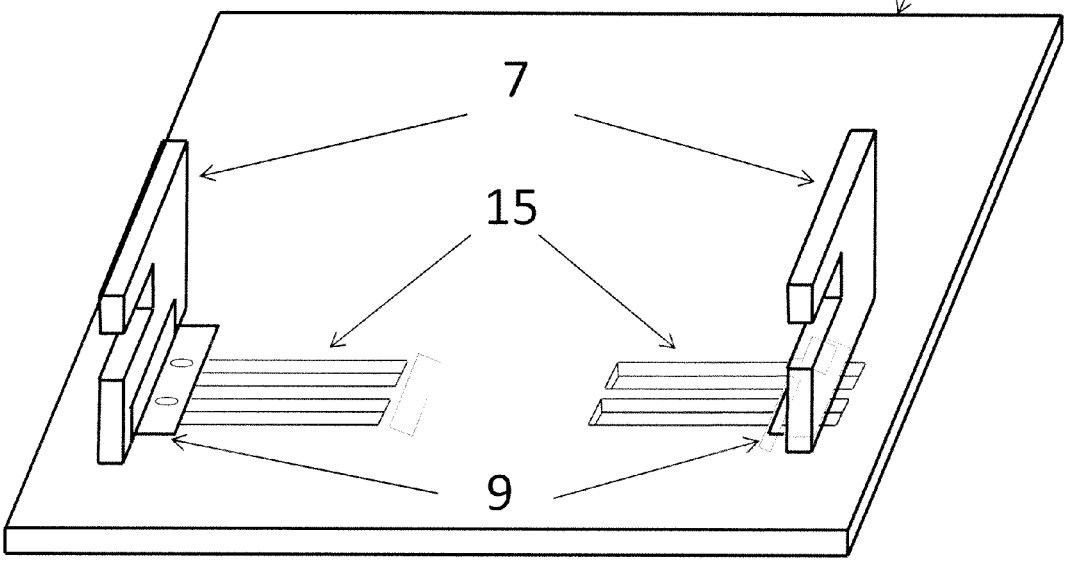
FIG. 20 is an illustration of the WDS Universal Base with slots.

The spacing between the front legs may vary from walker manufacturer to walker manufacturer. It is possible to make a universal WDS that will accommodate different size walkers. One method to accomplish this is to have multiple holes drilled in the base (14). The holes would allow the spacing between the WMRAs to vary and support numerous manufacturer walkers. FIG. 19 is an illustration of the WDS Universal Bases with predrilled holes that would allow the space between WMRAs to vary. Another method to accomplish this would be to have one or more slots (15) that would also allow the spacing between the WMRAs to vary and support numerous manufacturer walkers. FIG. 20 is an illustration of the WDS Universal Bases with slots that would allow the space between the WMRAs to vary.

There are walker users who need help in getting up from a sitting to a standing position; however, they are not so incapacitated that they require an aide or caregiver in helping them make this transition. For those walker users, a WDS that has a semi-automated loading system (SALS) could help them in the sitting to standing transition. See FIG. 21. The WDS SALS allows the user to back their walker into the docking station without the need of an aide or caregiver. This system uses a cable (17) where one end of the cable is tied to the WCP and the other end of the cable is tied to a sliding back-leg foot catch (BLFC) (16). The BLFC catches the walker's back leg (18) as the walker is sliding backwards and via the cable, the BLFC pulls on the WCP, rotating the WCP to an upright or vertical position at the same time securing the walker into the WDS.

Figure 21:
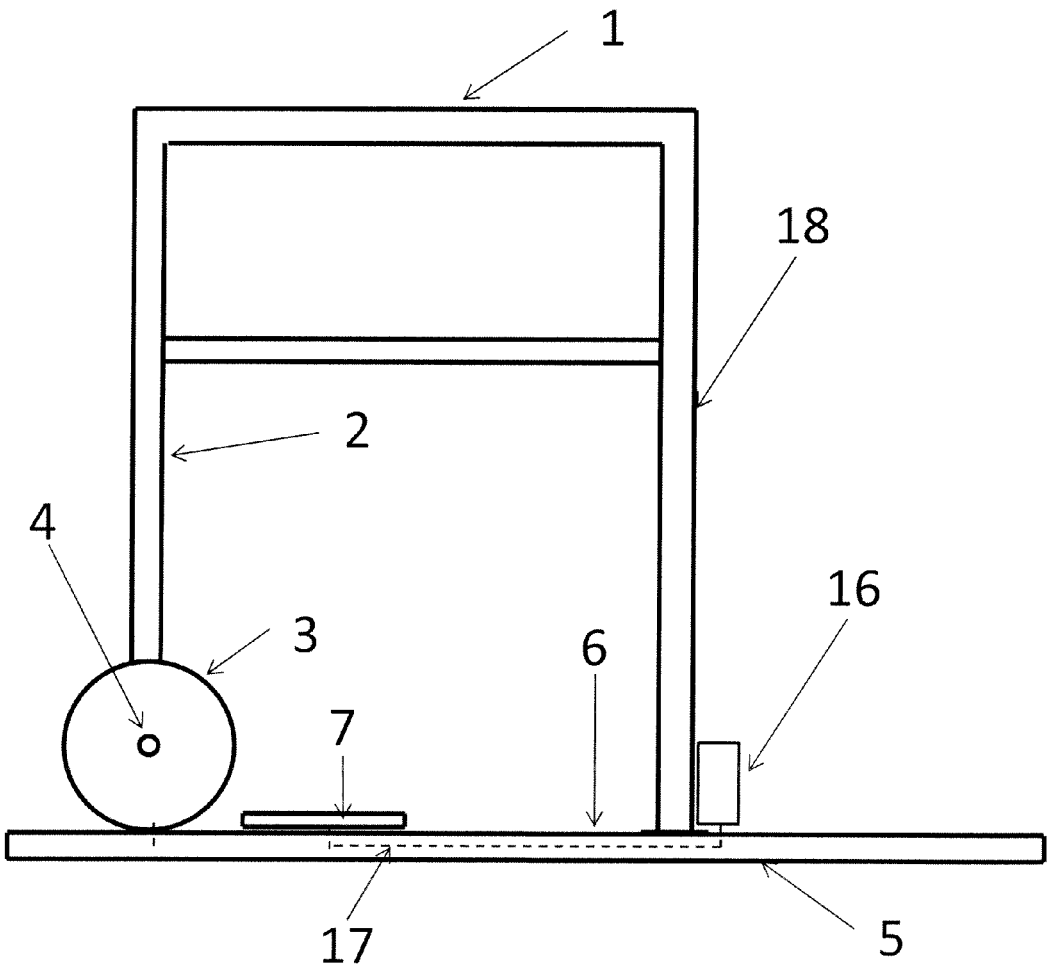
FIG. 21 is an illustration of the side view of a walker just prior to being captured.
Figure 22:
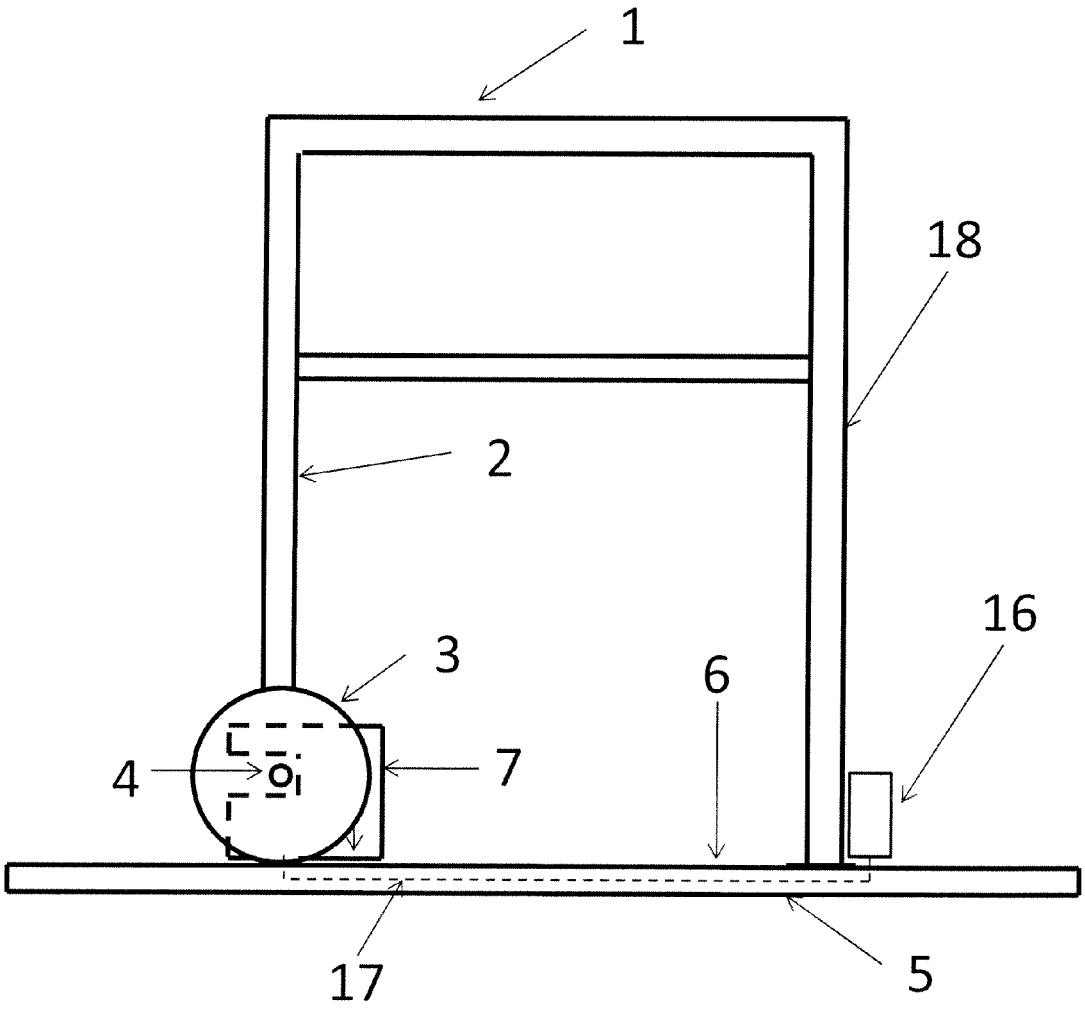
FIG. 22 is an illustration of the side view of a walker that has been captured or secured on a WDS.

FIG. 21 is an illustration of the side view of a walker just prior to being captured or secured by the SALS with the WCP in the down or horizontal position, and FIG. 22 is an illustration of the side view of a walker that has been captured or secured on a WDS by the SALS with the WCP in the upright or vertical position.

While the present invention has been described with reference to the above embodiments, this description of the preferred embodiments and methods is not meant to be construed in the limited sense. It should also be understood that all aspects of the present invention are not to be limited to the specific descriptions, or to configurations set forth herein. Variations in the present invention will be apparent to a person skilled in the art upon reference to the present disclosure. It is therefore contemplated that the following claims will cover any such modifications or variations of the described embodiment as falling within the true spirit and scope of the present invention.

The invention claimed is:

1. A walker stabilizing platform device for stabilizing a walker to aid a user of the walker to rise from a sitting position from an object upon which the user is sitting, said walker stabilizing platform comprising:

a stand-alone platform disposed on a surface and covering an area encompassing multiple legs of the walker, said stand-alone platform being placed adjacent to the object upon which the user is sitting, a movement restrictor assembly coupled to the platform, the movement restrictor disposed perpendicular to the platform for engaging with a portion of the walker, said movement restrictor assembly having an engaged position and a disengaged position, wherein in the engaged position, the movement restrictor assembly restricts movements of the walker in a direction perpendicular with the platform, but allows movements of the walker in a direction parallel with the platform and, wherein in the disengaged position the movement restrictor assembly is no longer disposed perpendicular to the platform but lies horizontal to and flat on the platform, and wherein the walker includes two legs with wheels attached to a lower portion of each leg via an axle, wherein the axle between each wheel and each leg engages with said movement restrictor assembly when said movement restrictor assembly is in said engaged position.

2. A walker stabilizing platform in accordance with claim 1 wherein the movement restrictor assembly is attached to the platform with a hinge.

3. A walker stabilizing platform in accordance with claim 1 wherein said movement restrictor assembly includes a self-closing hinge.

* * * * *